US005751827A

United States Patent [19]

Takahashi

[11] Patent Number: 5,751,827

[45] Date of Patent: May 12, 1998

[54] PIEZOELECTRIC SPEAKER

[75] Inventor: Masahiko Takahashi, Tokyo, Japan

[73] Assignee: Primo Microphones, Inc., McKinney, Tex.

[21] Appl. No.: 402,923

[22] Filed: Mar. 13, 1995

[51] Int. Cl.[6] ..... H04R 25/00

[52] U.S. Cl. ..... 381/190; 381/156; 381/173; 381/191

[58] Field of Search ..... 381/173, 190, 381/191, 156, 159; 340/388.1, 388.2, 388.4, 391.1; 310/322, 324

[56] References Cited

U.S. PATENT DOCUMENTS

| | | | |
|---|---|---|---|
| 3,687,221 | 8/1972 | Bonnard | 181/31 B |
| 3,792,204 | 2/1974 | Murayama et al. | 179/110 A |
| 3,917,024 | 11/1975 | Kaiser | 181/163 |
| 4,063,049 | 12/1977 | Pipitone et al. | 179/110 A |
| 4,297,538 | 10/1981 | Massa | 179/180 |
| 4,352,961 | 10/1982 | Kumada et al. | 310/324 |
| 4,413,198 | 11/1983 | Bost | 310/324 |
| 4,439,640 | 3/1984 | Takaya | 179/110 A |
| 4,449,019 | 5/1984 | Kakehi et al. | 179/110 A |
| 4,471,258 | 9/1984 | Kumada | 310/345 |
| 4,517,416 | 5/1985 | Goossens | 181/144 |
| 4,807,294 | 2/1989 | Iwata et al. | 381/190 |
| 4,949,387 | 8/1990 | Andert et al. | 381/190 |
| 4,969,197 | 11/1990 | Takaya | 381/190 |
| 4,979,219 | 12/1990 | Lin | 381/190 |
| 5,031,222 | 7/1991 | Takaya | 381/190 |
| 5,353,261 | 10/1994 | Kakiuchi et al. | 381/154 |

FOREIGN PATENT DOCUMENTS

| | | | |
|---|---|---|---|
| 0069999 | 4/1982 | Japan | 381/190 |
| 0311796 | 12/1989 | Japan | 381/190 |
| 0279000 | 11/1990 | Japan | 381/190 |
| 4-107098 A | 4/1992 | Japan | 381/159 |

*Primary Examiner*—Curtis Kuntz
*Assistant Examiner*—Rexford N. Barnie
*Attorney, Agent, or Firm*—Dennis T. Griggs

[57] ABSTRACT

A piezoelectric speaker includes a casing and cover member having a transverse wall extending therebetween which forms a sound transmission channel having a spiral curved or double reverse bend shape and being of substantially continuously increasing cross sectional area between an inlet portion of said channel and an outlet opening to atmosphere. A driver element comprising a diaphragm formed of fiber reinforced epoxy, polyester or ABS resin has a piezoelectric ceramic disk secured thereto and supported in a recess formed on the cover member. A sound transmission opening in the cover member communicates with the inlet portion of the sound transmission channel. The diaphragm may be formed integral with the cover member. The speaker has the capability of expanding the frequency band width of audible sound at relatively high sound pressure levels.

10 Claims, 3 Drawing Sheets

PIEZOELECTRIC SPEAKER

FIELD OF THE INVENTION

The present invention pertains to a piezoelectric ceramic speaker including a sound amplifying horn having a folded or curved sound transmission channel with increasing cross sectional area.

BACKGROUND OF THE INVENTION

Speakers for producing audible acoustic signals are used in a wide variety of consumer and industrial products. Many applications for audio speakers require the speaker to be relatively compact but capable of producing sound with a suitable intensity over a relatively wide frequency band such as within the hearing range of the human ear. In this regard speakers using piezoelectric ceramic elements or similar piezoelectric elements have been developed. Such speakers are inexpensive to manufacture, may be made relatively compact but have a limitation in regard to the fact that they are not particularly effective at amplifying sound and they produce sound in a relatively narrow frequency range or bandwidth.

Accordingly, dynamic speakers have been developed where a greater range of frequencies or a greater level of sound power is required. Such dynamic speakers usually use a permanent magnet which is relatively heavy and creates a strong magnetic field in the vicinity of the speaker. Packaging relatively sophisticated electronic devices can thus become a problem when dynamic speakers are used since the magnetic field of the speaker may interfere with other electrical signals generated by or for the device. Moreover, the manufacture of dynamic speakers using permanent magnets can be difficult. For example, in soldering the speaker circuit wires the magnetic material of the soldering tool is often attracted to the speaker magnet making difficult this manufacturing operation. Moreover, dynamic speakers have a relatively high manufacturing cost when compared with piezoelectric speakers, in particular.

DESCRIPTION OF THE PRIOR ART

Piezoelectric speakers which utilize piezoelectric ceramic elements have been developed with conventional bell-shaped sound amplification horns. However, these speakers take up a substantial amount of space, the configuration of the horn is not conducive to packaging the speaker in a desired location in many electronic devices and the overall size of the device may be increased beyond that which is desirable simply because of the size of the speaker horn.

Piezoelectric type speakers have also been developed which provide a driver element acoustically coupled to resonant structures disposed on opposite sides of the driver element to provide sound intensity at one or more resonant frequencies greater than the sound intensity produced by the driver element and to provide a broadened or enhanced bandwidth of frequencies at which sound of a suitable pressure level is produced. Again, these devices are particularly bulky and difficult to package into compact electronic devices.

Piezoelectric speakers have also been developed with horn members having a curved or wavy shaped channel which is alleged to promote or increase the sound output pressure level of the speaker. However, these wavy channels are not indicated to have continuously or even intermittently increasing cross sectional area which is important to the development of a relatively broad bandwidth of sound at a significantly higher pressure level than is obtainable with piezoelectric speakers without sound amplification horns. Accordingly, there has been a continuing need to provide improved piezoelectric type speakers, particularly using piezoelectric ceramic driving elements, which are capable of providing a relatively broad band of audible frequencies at a relatively high sound intensity or pressure level. It is to these ends that the present invention has been developed.

SUMMARY OF THE INVENTION

The present invention provides an improved piezoelectric speaker which is capable of producing sound over a relatively broad bandwidth or range of frequencies at a substantially higher sound intensity or sound pressure level than is obtainable with a piezoelectric speaker without a sound amplification horn.

In accordance with one important aspect of the present invention, a piezoelectric speaker is provided with a casing defining a curved channel which terminates at a relatively large crosssectional area sound outlet opening and which is capable of producing sound over a relatively broad range of frequencies at an improved sound intensity or pressure level. The curved sound transmission channel may be a spiral shaped channel of increasing cross sectional area between the point of input of vibrations from the driver element to the point of discharge of the sound pressure waves to atmosphere. One embodiment of the invention provides a horn with a sound transmission channel which has one or more reverse bends in a folded or a somewhat S-shaped configuration, also of increasing cross-sectional area, from the point of input of acoustic vibrations to sound exit from the horn.

In accordance with yet a further aspect of the invention, a piezoelectric speaker is provided with a piezoelectric ceramic disk suitably secured to a diaphragm made of a high molecular weight polymer, for example, and which is supported in relation to a uniquely configured sound amplification horn such that a relatively compact speaker may be provided having a sound output characteristic which produces relatively high sound pressure over a relatively broad frequency range. The speaker may be constructed of three basic parts, namely, a casing defining the curved channel, a cover for the casing and a driving element made of a relatively thin diaphragm of a high molecular weight reinforced resin for supporting a piezoelectric element thereon.

Still further, the cover itself may be configured to include the diaphragm as an integral part of the cover wherein the cover and diaphragm are made of the same material. The walls defining the channel may be formed either on the casing or on the cover. The cover and/or the casing provides room for mounting a circuit board or other component associated with the speaker and its driving element.

The speaker exhibits a relatively high impedance whereby the audio output intensity of the speaker may be increased without requiring a power amplifier. Moreover, the provision of the curved or reverse bend shaped or folded sound transmission channel enables the speaker to be manufactured such that it is relatively small and is easy to incorporate into various electronic devices requiring speakers.

Those skilled in the art will appreciate the above-mentioned features and advantages of the invention together with other superior aspects thereof upon reading the detailed description which follows in conjunction with the drawing.

DESCRIPTION OF PREFERRED EMBODIMENTS

Figure 1:
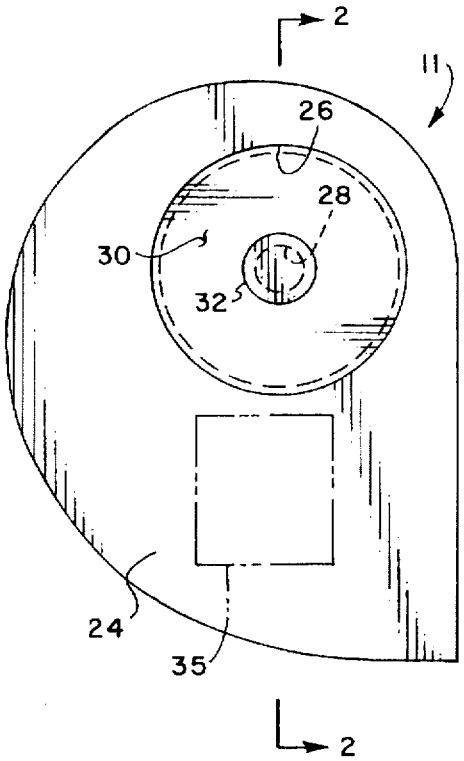
FIG. 1 is a side elevation of one preferred embodiment of a piezoelectric speaker in accordance with the present invention.

In the description which follows like parts are marked throughout the specification and drawing with the same reference numerals, respectively. The drawing figures are not necessarily to scale in the interest of clarity and conciseness.

Figure 3:
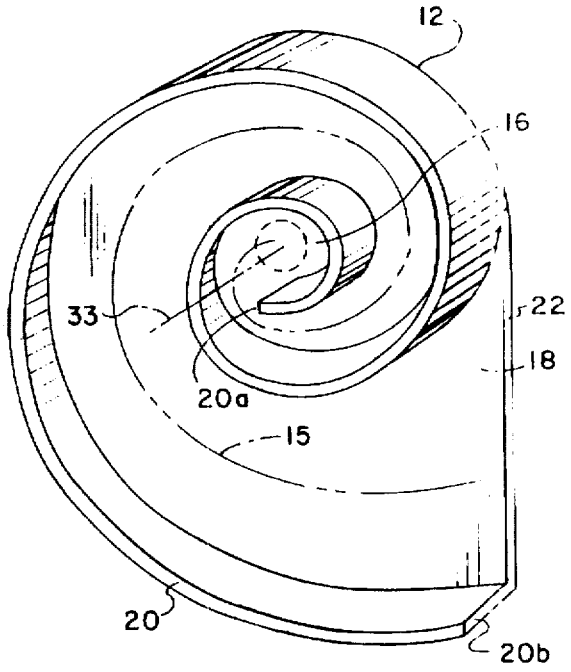
FIG. 3 is a perspective view of the casing of the speaker shown in FIG. 1 illustrating the configuration of the spiral shaped sound transmission channel.
Figure 2:
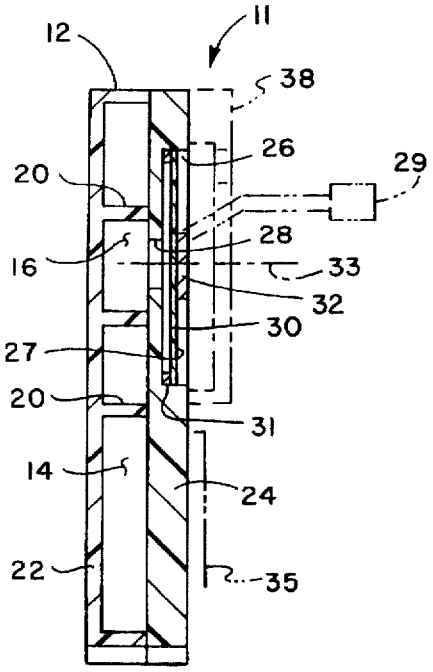
FIG. 2 is a section view taken generally along the line 2—2 of FIG. 1.

Referring to FIGS. 1–3, there is illustrated a unique piezoelectric speaker, generally designated by the numeral 11. The speaker 11 includes a casing 12 having a somewhat spiral curved sound transmission and amplification channel 14, FIG. 3, formed therein and originating generally at a sound inlet portion 16 and terminating at a sound outlet opening 18. The channel 14 is formed by a continuously curved transverse wall 20 of the casing 12 which, together with a generally planar sidewall 22, substantially defines the casing 12. The transverse wall 20 is delimited by opposed distal edges 20A and 20B.

Referring now to FIG. 2, the speaker 11 further includes a generally planar cover member 24 having substantially the same shape as the shape of the sidewall 22 and being adapted to be suitably secured to the casing 12 to enclose the channel 14. The channel 14 has a continuously curved shape from the edge 20A to the edge 20B and is of substantially continuously increasing cross sectional area between these limit edges of the transverse wall 20. The cross sectional area of the channel 14 preferably increases exponentially along and in a plane normal to a central longitudinal axis 15, FIG. 3, from the edge 20A to the outlet opening 18, the exponential relationship preferably being to the base e of the natural logarithms.

Referring further to FIGS. 1 and 2, the cover 24 is provided with a generally cylindrical recess 26 formed therein and being concentric with a circular sound transmission opening 28 which opens from the recess 26 into the inlet portion 16 of the channel 14. The speaker 11 also includes a unique driving element characterized by a generally circular, somewhat flexible diaphragm member 30 which stands off from a wall 27 defining the bottom of recess 26. The standoff position of the diaphragm 30 may be provided by a shoulder in the recess 26 or by a cylindrical ring or collar 31 of substantially rigid material which is disposed in the recess 26 and positions the diaphragm 30 in the standoff position from the recess bottom wall 27.

The diaphragm 30 is preferably made of a relatively high molecular weight composition reinforced with an inorganic fiber. For example, the high molecular weight material may comprise a polymer such as epoxy resin impregnated with glass fibers. Alternatively, the flexible sheet forming the diaphragm 30 may be made of an ABS or polyester resin with glass or carbon fibers as the inorganic reinforcement material. A piezoelectric ceramic disk 32 is disposed centrally on the diaphragm 30 and is suitably secured thereto. The disk 32 may be formed of a conventional polarized ceramic material used for piezoelectric ceramic speaker driving elements. The disk 32 is provided with thin electrodes, not shown, attached to the opposed planar surfaces of the disk, which electrodes are suitably electrically connected to an electrical signal source 29, shown schematically in FIG. 2, for providing sound generating signals to the speaker 11. When a suitable electrical signal is imposed on the piezoelectric ceramic disk 32 it changes shape to effect vibration of the diaphragm 30 and generation of sound waves by this movement which travel through the opening 28, channel 14 and enter the atmosphere at the channel outlet opening 18. The aforementioned arrangement for generating acoustic vibrations and the resultant movement of air in the channel 14 produces amplified sound waves which have a higher intensity or sound pressure level over a broader range of frequencies than is obtainable with known types of piezoelectric ceramic speakers. Moreover, by arranging the driver element, such as the diaphragm 30 and disk 32, to vibrate along an axis 33 substantially normal to the channel 14, a unique, compact speaker is provided.

Figure 5:
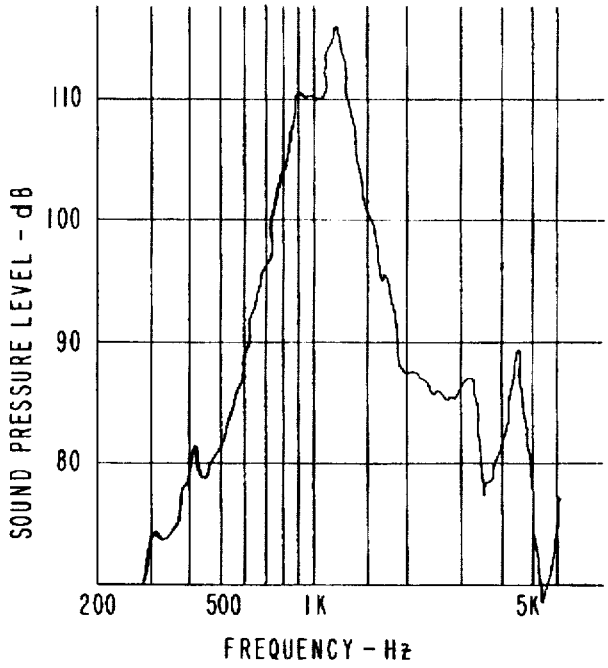
FIG. 5 is a diagram showing the sound output characteristics of a piezoelectric speaker without the sound amplification horn arrangement of the present invention.
Figure 6:
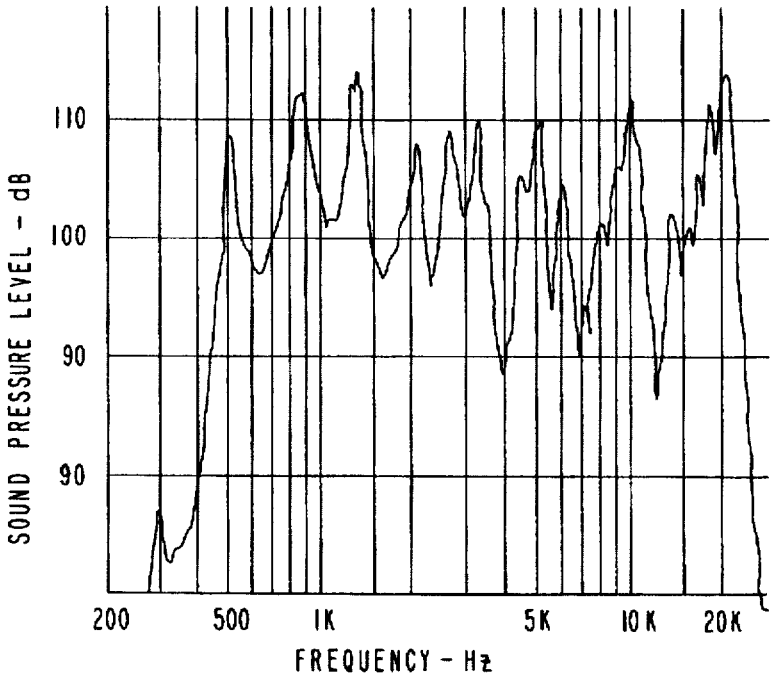
FIG. 6 is a schematic diagram showing the sound output characteristics of the same speaker having a sound transmission and amplification horn in accordance with the invention.

By way of example, referring to FIG. 5, there is illustrated the frequency characteristic in hertz (Hz) versus sound pressure level in decibels (dB) for the above-described piezoelectric ceramic speaker with the cover 24 removed from the casing 22. In this condition of operation of the speaker, it is indicated that the driving element comprising the combination of the ceramic disk 32 and the diaphragm 30 has a peak output sound pressure level at a frequency of approximately 1200 Hz. Conversely, in FIG. 6, the speaker 11, with the cover 24 and casing 12 assembled, produces a substantially higher gain at a lower frequency wherein a sound pressure level of about 108 dB is achievable at 500 Hz and a sound pressure level of at least about 90 dB is obtainable over a range of frequencies of from about 450 Hz to over 20,000 Hz.

Moreover, the speaker 11 has the characteristic of capacity impedance which varies from about 10 k ohms to about 100 k ohms through a frequency range of from 300 Hz to 3,000 Hz. This capacity impedance characteristic is nearly one hundred times that of a dynamic style speaker and thus the speaker 11 consumes only about 1/100th as much current. Accordingly, the speaker 11 may be used in many circuits without a power amplifier as would be required by the so-called dynamic style speakers.

The performance characteristics of the speaker 11 described above and illustrated in FIGS. 5 and 6, were obtained with a speaker having a maximum length of about ninety-four millimeters (the vertical direction in FIG. 1), a width of about seventy-two millimeters (the horizontal direction in FIG. 1) and a thickness of about twenty millimeters. The performance characteristics were measured using an input voltage of about twenty-four volts peak-to-peak and the measurements were made by placing a microphone at a distance of about twenty centimeters from the opening 16 with the casing 12 removed from the cover 24.

and at a similar distance from the outlet opening 18 with the casing 12 assembled to the cover 24.

Referring briefly again to FIG. 2, the arrangement of the planar cover 24 and casing 12 also provides for mounting a suitable circuit board 35, for example, on the cover outer surface, where indicated in FIG. 2. Alternatively, the circuit board 35 could be mounted on the outer surface 13 of the cover 12. Still further, a suitable protective ported cover 38 may be provided for covering the diaphragm 30 and the piezoelectric ceramic disk 32 to prevent unwanted exposure of these elements to the environment.

Figure 7:
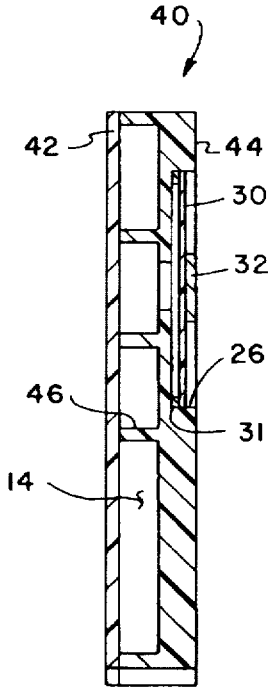
FIG. 7 is a section view of an alternate embodiment of the invention taken along the same line as the view of FIG. 2;.

Referring briefly to FIG. 7, an alternate embodiment of the speaker described above and shown in FIGS. 1–3, is illustrated and generally designated by the numeral 40. The speaker 40 is essentially similar to the speaker 11 but has a planar casing member 42 and a cover 44 which is formed integral with a transverse wall 46 which forms the spiral channel 14. Accordingly, the transverse wall 46 which forms the spiral sound amplification and transmission channel 14 is part of the cover member 44 instead of the casing 42 and the casing may, essentially, become the cover member.

Figure 4:
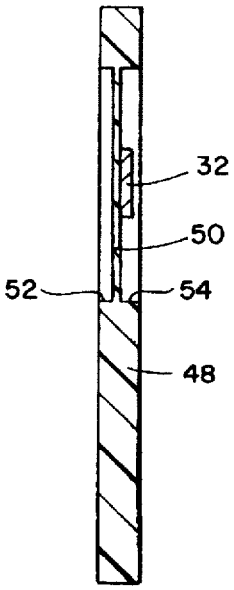
FIG. 4 is a section view of an alternate embodiment of a cover and driver element for the speaker of FIG. 1.

Referring also to FIG. 4, there is illustrated a second alternate embodiment of the invention wherein a generally planar cover member 48 is illustrated and having the same shape as the cover member 24 for use with the casing 12. However, the cover member 48 has an integral diaphragm 50 formed by opposed circular recesses 52 and 54. A piezoelectric ceramic disk 32 is suitably bonded to the diaphragm 50. Suitable conductive paths or conductors, not shown, are connected to the opposed electrode films, not shown, formed on the ceramic disk 32 to provide the driving energy to deflect the disk and cause the diaphragm 50 to flex or vibrate in essentially the same manner as the diaphragm 30. Accordingly, the cover 48 may, in its entirety, be molded of the aforementioned epoxy resin containing glass fiber reinforcement providing the diaphragm 50 with substantially the same physical and performance features as the diaphragm 30.

In a cover 48, having dimensions which would conform to the dimensions for the speaker 11 and replacing the cover 24, the circular diaphragm 50 may be formed to have a thickness of only about 0.2 millimeters. Other materials may be used for the cover 48 including polyester or an ABS type moldable plastic with glass fiber reinforcement or carbon fiber reinforcement. Such high molecular weight polymer materials are able to form thicknesses or as little as 0.1 millimeters in the molding process. The covers 24 and 48 may be attached to the casing 12 by adhesives, mechanical fasteners or welding. The major difference between the cover 24 and the cover 48 is that the speaker diaphragm is an integral part of the cover 48 and is molded with the cover itself.

Figure 8:
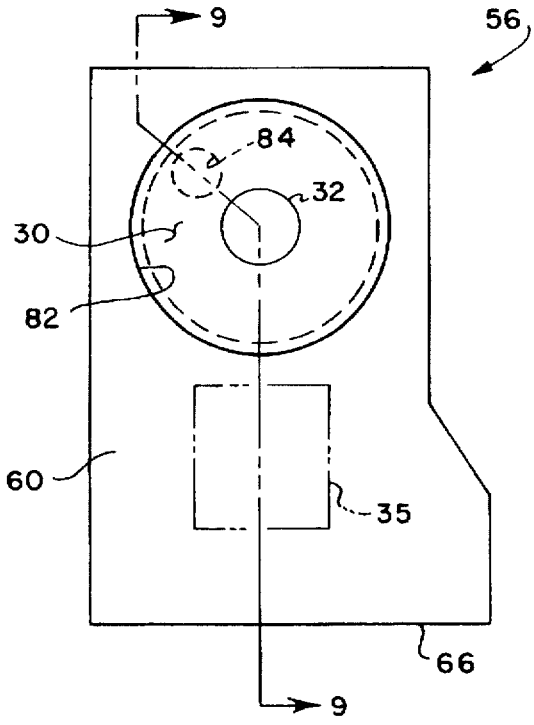
FIG. 8 is a side elevation of an alternate embodiment of a speaker in accordance with the invention.
Figure 9:
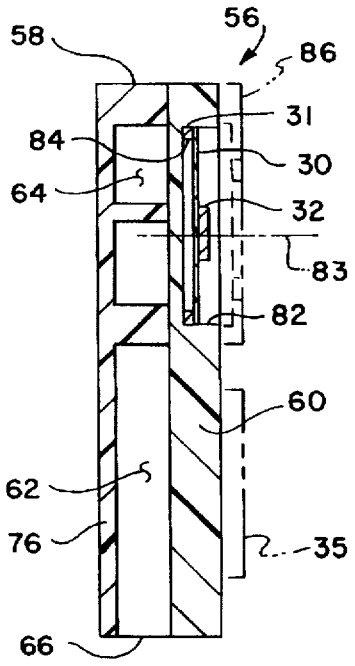
FIG. 9 is a section view taken generally along the line 9—9 of FIG. 8.
Figure 10:
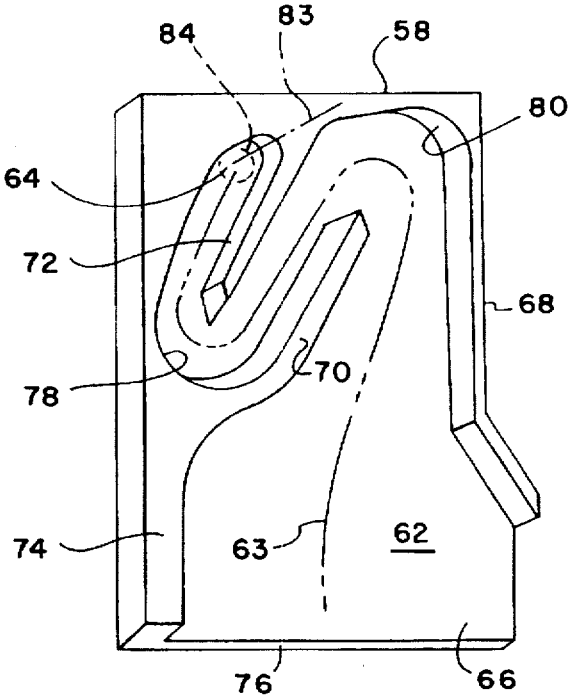
FIG. 10 is a perspective view of the casing of the speaker shown in FIGS. 8 and 9.

Referring now to FIGS. 8 through 10, still another embodiment of a piezoelectric ceramic speaker is illustrated and generally designated by the numeral 56. The speaker 56 is similar in some respects to the speaker 11 in that it is provided with a molded plastic casing 58 and a cooperating molded plastic cover 60 suitably connected to the casing 58 in a manner similar to the arrangement of the speaker 11. As shown in FIG. 10, the casing 58 is formed to have a sound transmission and amplification channel 62, preferably with substantially continuously increasing cross sectional area between a sound inlet portion 64 and a sound discharge or outlet opening 66.

The channel 62 is formed by transverse wall portions 68, 70, 72 and 74 which may be integrally formed as part of the cover 58 together with a generally planar sidewall 76. The channel 62 is formed with two substantially reverse bends 78 and 80 defined by the transverse walls 68, 70, 72 and 74, as illustrated in FIG. 10. Moreover, the cross sectional area of the channel 62 preferably increases substantially continuously along a central longitudinal axis 63, preferably as a function of natural base e, between the inlet portion 64 and the outlet opening 66. In this way the speaker 56 has substantially the same sound transmission and amplification characteristics as the speaker 11 and may be substantially as compact as the speaker 11, thanks to the provision of the reverse bends 78 and 80 between the channel inlet and outlet portions.

As shown in FIGS. 8 and 9, the cover 60 is provided with a generally cylindrical recess 82, similar to the recess provided in the cover 24, in which the diaphragm 30 and the piezoelectric ceramic element 32 may be disposed and held in a standoff position by the substantially rigid ring 31. Alternatively, the recess 82 may be formed with an integral shoulder in place of the ring 31 in the same manner as may be provided for the recess 26. As further shown in FIGS. 8 and 9, the cover 60 also has a sound transmission opening 84 which opens to the inlet portion 64 of the channel 62 and also communicates with the recess 82. However, the opening 84 is disposed somewhat eccentric to the central axis 83 of the circular recess 82 in order that it coincide with the inlet portion 64 of the channel 62. The axis 83 is also substantially normal to the axis 63 of the channel 62.

As shown in FIG. 9 the cover 60 may also be provided with a ported protective cover 86 and may also include a suitable circuit board 35 or the like disposed thereon. Alternatively, the wall 76 of the casing 58 may be adapted to support a suitable circuit board or the like, not shown. The speaker 56 may be constructed of the same materials as the speaker 11 and has essentially the same sound generating and amplification characteristics as the speaker 11. The cover 60 may also be formed to have an integral diaphragm, not shown, similar to the arrangement for the cover 48 with its integral diaphragm 50.

Those skilled in the art will appreciate from the foregoing description that a unique piezoelectric ceramic speaker is provided by the embodiments of the invention described herein and shown in drawing FIGS. 1 through 10. The fabrication and operation of the speakers 11, 40 and 56 are believed to be within the purview of those skilled in the art from the foregoing description. Although preferred embodiments of the invention have been described in certain detail hereinabove, those skilled in the art will also recognize that various substitutions and modifications may be made to the specific structure of the disclosed embodiments without departing from the scope and spirit of the invention as set forth in the appended claims.

What is claimed is:

1. A speaker for generating sound comprising:

a casing;

a cover member;

a diaphragm integrally formed with a selected one of said casing and said cover member;

a speaker driving element supported on said diaphragm; and means defining a transverse wall between said casing and said cover member and forming a sound transmission channel, said channel having an inlet portion disposed in communication with said diaphragm and an outlet opening to atmosphere, said channel having an increasing cross sectional area between said inlet portion and said outlet opening.

2. The speaker set forth in claim 1 wherein:

said traverse wall means forming at least two substantially reverse bends in said channel between said inlet portion and said outlet opening.

3. The speaker set forth in claim 1 herein:

said driving element comprises a piezoelectric disk secured to said diaphragm and responsive to an electrical signal imposed thereon to vibrate said diaphragm to transmit sound through said transmission channel.

4. The speaker set forth in claim 1 wherein:

said diaphragm and said selected one of said casino and said cover member are integrally formed of a high molecular weight composition selected from a group consisting of epoxy, polyester and ABS resins.

5. The speaker set forth in claim 4 wherein:

said composition is reinforced with an inorganic fiber selected from a group consisting of glass and carbon.

6. The speaker set forth in claim 1 wherein:

said selected one of said casing and said cover member being intersected by a recess; and, said diaphragm forming a boundary of said recess.

7. The speaker set forth in claim 1 wherein:

said transverse wall means being integrally formed with a selected one of said casing and said cover member.

8. A speaker for generating sound comprising:

a casing;

a cover member;

a speaker driver assembly including a diaphragm integrally formed with a selected one of said casing and said cover member; and means defining a transverse wall between said casing and said cover member and forming a sound transmission channel, said channel having an inlet opening coupled to said speaker driving element and an outlet opening coupled to atmosphere, said transverse wall means forming at least two reverse bends in said channel between said speaker driving element and said outlet opening.

9. The speaker set forth in claim 8 wherein:

said transverse wall means being integrally formed by a selected one of said casing and said cover member.

10. The speaker as set forth in claim 8 wherein:

said transverse wall means including a main body portion, a first wall segment extending from said main body portion and a second wall segment extending from said main body portion, said first and second wall segments being separated from each other and from said main body portion by the sound transmission channel.

* * * * *

UNITED STATES PATENT AND TRADEMARK OFFICE

CERTIFICATE OF CORRECTION

PATENT NO. : 5,751,827

DATED : May 12, 1998

INVENTOR(S) : Masahiko Takahashi

It is certified that error appears in the above-indentified patent and that said Letters Patent is hereby corrected as shown below:

Claim 4, column 7, line 12, "casino" should be -- casing --.

Signed and Sealed this

Fourteenth Day of July, 1998

Bruce Lehman

*Attest:*

BRUCE LEHMAN

*Attesting Officer*

*Commissioner of Patents and Trademarks*